United States Patent [19]

Fulkerson et al.

[11] Patent Number: 4,715,471

[45] Date of Patent: Dec. 29, 1987

[54] SELF-PROPELLED PERCUSSION UNIT AND METHOD OF USING SAME

[76] Inventors: David W. Fulkerson, 8360 W. Six Mile Rd., Northville, Mich. 48167; Lawrence W. Smith, 26950 Taft Rd., Novi, Mich. 48050

[21] Appl. No.: 30,764

[22] Filed: Apr. 17, 1979

Related U.S. Application Data

[63] Continuation of Ser. No. 830,022, Sep. 2, 1977, abandoned, which is a continuation-in-part of Ser. No. 625,141, Oct. 23, 1975.

[51] Int. Cl.[4] ..... G01V 1/04; G01V 1/10

[52] U.S. Cl. ..... 181/121; 181/114; 181/401; 367/75

[58] Field of Search ..... 181/113, 114, 121, 401; 367/75; 173/39, 42, 86, 89, 128, 131, 45, 81, 93, 43; 61/53.5

[56] References Cited

U.S. PATENT DOCUMENTS

| | | | |
|---|---|---|---|
| 2,711,078 | 6/1955 | Guild | 173/43 |
| 2,740,488 | 4/1956 | Heaps | 181/121 |
| 2,928,322 | 3/1966 | Spitzer | 173/42 |
| 3,088,385 | 5/1963 | Dorkins et al. | 173/86 |
| 3,172,483 | 3/1965 | Spitzer | 173/43 |
| 3,277,977 | 10/1966 | Silverman | 181/121 |
| 3,283,845 | 11/1966 | Kenney | 181/114 |
| 3,379,273 | 4/1968 | Chelminski | 181/113 |
| 3,393,763 | 7/1968 | Sundt | 181/114 |
| 3,550,719 | 12/1970 | Meister | 181/114 |
| 3,835,954 | 9/1974 | Layolte | 181/401 |
| 3,885,646 | 5/1975 | Knight et al. | 181/114 |
| 4,050,540 | 9/1977 | Cholet et al. | 181/121 |
| 4,059,820 | 11/1977 | Turpening | 181/113 |
| 4,118,994 | 10/1978 | Layotte et al. | 181/121 |
| 4,222,454 | 9/1980 | Airhart | 181/121 |
| 4,655,314 | 4/1987 | Airhart | 181/121 |
| 4,660,674 | 4/1987 | Airhart | 181/121 |
| 4,660,675 | 4/1987 | Airhart | 181/121 |

FOREIGN PATENT DOCUMENTS

| | | | |
|---|---|---|---|
| 616602 | 7/1978 | U.S.S.R. | 367/75 |

*Primary Examiner*—Nelson Moskowitz

*Attorney, Agent, or Firm*—Harness, Dickey & Pierce

[57] ABSTRACT

A wheeled, self-propelled tractor has a percussion tool or hammer mounted on its forward end and an impact transmitting means carried on the tractor below the hammer. In accordance with one aspect of the invention, the impact transmitting means comprises a metal frame having a strong rigid top plate that is struck by the hammer and a downwardly opening cavity in which wood timbers are mounted to transmit the impact from the plate to a cemetery marker. Repeated blows to the marker applied through the impact transmitting means will drive the marker into the ground until it is flush with the ground surface where it will not interfere with mowing. The frame is fastened on the vehicle by a suspension system that includes tension springs which keep the wood timbers in a horizontal plane but permit the frame to move downwardly each time it is struck by the hammer.

In accordance with a second aspect of the invention, method and apparatus for generating seismic waves for sub-surface geophysical exploration are described in which a weighted impact hammer is guided along an elongated track against a shock-transmitting plate. In a first mode of operation for generating seismic P-waves, the track is oriented in the vertical direction and the hammer is permitted to fall by force of gravity against the impact plate which is disposed on the earth surface therebelow. In a second mode of operation for generating seismic shear waves, the track is oriented at a selected shear angle with respect to the earth surface and guides the falling hammer against the shock-transmitting plate which is least partially penetrates the earth surface.

4 Claims, 20 Drawing Figures

RECORDER
RECEIVER
TRANSMITTER
TRANSDUCER
TRANSDUCER
10
242
290
292
294
296
298
300
302
304
305
306
307
308
310
312
314
316
318
320
322
324
326
328
18

SELF-PROPELLED PERCUSSION UNIT AND METHOD OF USING SAME

This is a continuation of application Ser. No. 830,022, filed Sept. 2, 1977, now abandoned, which application is a continuation-in-part of application Ser. No. 625,141 filed Oct. 23, 1975.

A first aspect of the present invention relates generally to a method and apparatus for reducing the cost of maintaining a cemetery and, more particularly, to a self-propelled percussion unit, and method of using same, especially adapted for driving previously installed cemetery markers into the ground so that grass can be cut with a mower running over the cemetery markers with the mower blade operating at a normal cutting height.

The present invention also relates in accordance with a second aspect thereof to seismic wave generators and methods for subsurface geophysical exploration, and, more particularly, to generators and methods of the described type for selectively generating either P- or shear exploration waves.

In recent years, the cost in maintaining cemeteries has increased dramatically to the point where cemetery maintenance is a real problem. Where cemetery markers were installed projecting above the ground, a self-propelled mower cannot pass over the raised marker when the mower blade is operating in a normal cutting position. The cost to hand trim markers is becoming prohibitive, and mowing costs are substantial if a mower must maneuver around protruding markers. The problem has become so severe that a large number of cemeteries no longer permit a marker to be installed projecting above the ground where it will interfere with a self-propelled mower. Although grass immediately around a grave marker can be controlled by grass killers and the like, this is expensive and still requires that the mower negotiate around the raised markers. The increase in maintenance cost caused by the raised markers has in some cases been sufficient to justify cemetery workers digging up markers and their foundations, deepening the excavation and then reinstalling the foundation and the marker flush with the ground. This manual operation is time consuming and expensive, and the cost to manually relocate the marker flush with the ground can easily be on the order of $10 to $20 per marker. This cost is almost prohibitive with large older cemeteries having literally thousands of raised cemetery markers.

Prior art techniques for generating seismic waves for subsurface geophysical exploration, particularly shear exploration waves generated at an angle of less than ninety degrees with respect to the earth surface, have proven to be less than satisfactory from the standpoint of repeatability and/or impact upon the surrounding environment. For example, the most successful technique for generating shear exploration waves in accordance with the prior art invloves burying the base of a four-inch mortar in the ground and then exploding a charge in the mortar tube at a selected shear angle with respect to the base. Although this technique has been adequate for generating seismic waves of substantial amplitude, it has been found to be extremely difficult to duplicate exactly the explosive charge and therefore generate repeated waves of similar amplitude. Moreover, the noise and matter exploding from the mortar tube may present a substantial hazard to persons or animals in the surrounding area.

A principal object of the present invention is to reduce the cost in maintaining cemeteries that presently have cemetery markers projecting above the ground sufficiently to interfere with a self-propelled mower passing over the marker while it is cutting grass.

A further object of the present invention is to provide a self-propelled percussion unit having a specially constructed impact transmitting arrangement that rapidly and effectively drives cemetery makers flush with the ground at relatively low cost, without damaging the marker, and in a relatively short time compared to prior manual marker relocation techniques; that is usable with markers of various different configurations; and/or that can be constructed by relatively simple modification of existing percussion units presently used for other purposes.

A further object of the present invention is to provide a method for relocating cemetery markers of the type referred to above in a manner that is simple, usable with a wide variety of marker configurations, relatively low in cost by comparison to prior manual techniques, that will not damage the markers and/or that can be readily implemented by relatively simple modification of existing percussion units presently used for the other purposes.

A second general object of the present invention, is to provide a method and apparatus for generating subsurface seismic waves which is simple and econimical in operation, which may be repeated with substantial accuracy and/or which greatly reduces potential hazards to the surrounding environment.

A more specific object of the invention is to provide an improved method and apparatus for generating subsurface seismic shear waves.

In connection with the above, yet another object of the invention is to provide an improved method of subsurface goephysical exploration utilizing seismic shear waves.

A further object of the invention is to provide an apparatus for selectively generating seismic waves of either the P-wave or shear wave type.

Other objects, features and advantages of the present invention will become apparent in connection with the following description, the appended claims and the accompanying drawings in which:

FIG. 2 is a side elevational view of the front portion of the self-propelled unit shown in FIG. 1;

Figure 1:
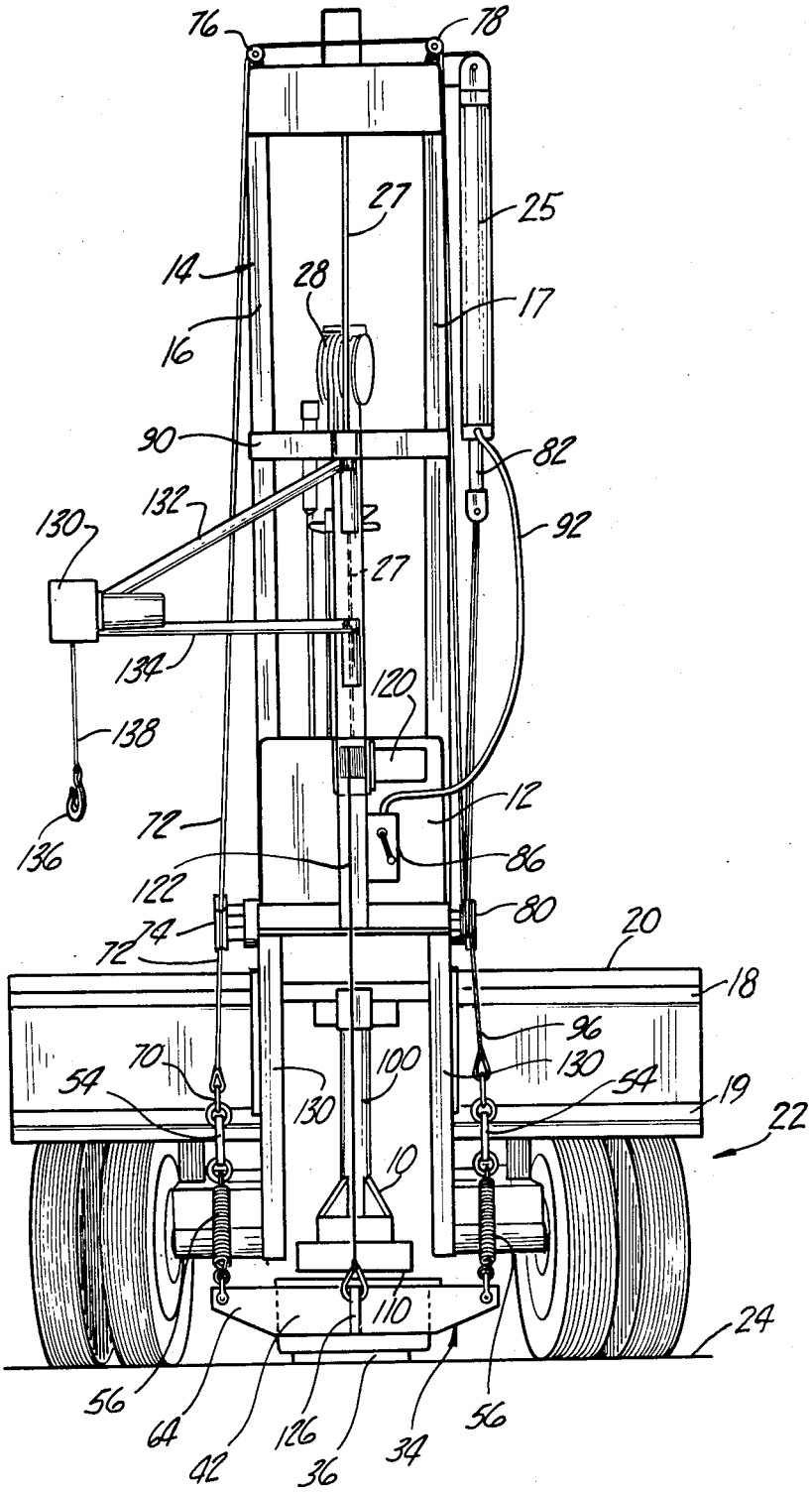
FIG. 1 is a front view of a self-propelled persucsion unit for driving cemetery markers into the ground according to the present invention.

Referring to the drawings in general, a hammer 10 is carried at the lower end of a heavy weight 12 which is longitudinally reciprocally mounted on a track or tower 14 comprising first and second laterally spaced inwardly tapering track members 16, 17 slidably received in corresponding channels in the weight side edges. Tower 14 is carried on tracks 18, 19 for transverse positioning relative to a frame 20 which, in turn, is carried by a hinge bracket 21 for pivotal movement in a vertical plane, as best appreciated by comparing FIGS. 11 and 12. Track 14 is additionally carried for pivotal adjustment in the direction of the plane of track members 16, 17 be means not shown between track 14 and frame 20. Bracket 21 is carried by self-propelled wheel vehicle 22 for translocation of the apparatus over the earth surface 24. A hydraulic ram 25 is carried by a support bracket 26 on vehicle 22 and is powered by the vehicle engine (not shown) to lift hammer 10 and weight 12 by means of a cable 27 trained over suitable idler pulleys 28. Additionally, lateral adjustment of track 14 with respect to frame 20 and pivotal adjustment with respect to bracket 21 are powered by hydraulic rams (not shown). The various hydraulic systems, including ram 25, are interconnected by hoses 29 and are selectively controlled by an operator of vehicle 22, as by a control handle 30.

With the exception of modifications to be hereinafter described, the arrangement and contruction thus far set forth may be substantially identical to that described and disclosed in U.S. Pat. No. 3,172,483, granted Mar. 9, 1965, which patent is incorporated herein by reference. Self-propelled percussion units of this general type are well known for a multiplicity of uses, for example, tamping fills, cutting and breaking pavement, driving posts and pilings, and the like, and are available from several manufacturers including the Arrow Manufacturing Company of Denver, Colo. to which the aforementioned U.S. Pat. No. 3,172,483 was assigned. When an operator initially energizes ram 25, cable 27 is retracted to move weight 12 and hammer 10 upwardly on opposed track members 16,17 to a raised position, generally anywhere from an inch or so up to several feet, for example eight feet, above the earth surface. At this point, the hydraulic system releases weight 12 so that it falls freely by force of gravity to develop a high impact force at hammer 10. Typically, weight 12 might be on the order of one thousand pounds or more.

In conventional percussion units, the controls of the hydraulic systems are arranged such that, once the operator initiates the operation, the cylinder will be cycled repeatedly until the operator deactivates the control. According to one aspect of the present invention, the hydraulic control is modified so that the weight 12 and hammer 10 are raised and dropped only once each time the operator actuates the control, as by control handle 30. This is a very simple modification that can be accomplished by by-passing the automatic sequencing valve. Aside from this minor modification and the modification of the hammer as will described, the above described percussion unit may be otherwise substantially identical to the aforementioned commercially available units.

According to a first aspect of the present invention, the commercially available percussion unit is modified by adding an impact transmitting member 34 that can be raised and lowered independently of hammer 10 and can be positioned below hammer 10 on top of a cemetery grave marker 36. More particularly, the member 34 comprises a generally rectangular frame 38 having a pair of side or end plates 40, front and rear plates 42, 43 and top plate 44. The plates are securely welded together to form a downwardly opening cavity 46 in which wood timbers 48 are mounted so as to fill the cavity and project below plates 41, 42, 43 and form a flat, lower cushion surface 50 for engaging directly against marker 36. The frame 38 and particularly the top plate 44 must be rigid, strong and hard to withstand repeated severe impact forces from hammer 10. In one embodiment of the present invention, top plate 44 was a 2-inch thick steel plate, 26 inches in depth (in a direction longitudinally of the wheeled tractor 18) and 22 inches wide (in a direction transversely of the tractor 18). Plates 40, 42, 43 are formed of 1-inch thick steel plate, 4 inches tall so that the cavity 46 can accommodate two 8"×10"×24" wood timbers of generally rectangular cross section with the upper surface of the timbers bottomed against the lower surface of top plate 44. Although the timbers can be maintained in the cavity by making them slightly oversized and driving them in place, preferably they are held in place on the frame 38 by a pair of bolts 52 that extend transversely through the timbers and the side plates 40. Although various types of wood timbers could be used, it has been found that elm timbers operate very effectively since, although very soft in comparison to steel, elm is a relatively hard wood that will withstand repeated impact against the marker without splitting and splintering.

Frame 38 is connected to a pair of triangular hanger plates 54 located, respectively, at opposite sides of tower 14 by means of four tension springs 56, 57, 58, 59 at each plate 54 as best shown in FIG. 2. The front spring 56 is fastened at its upper end to the front of plate 54 by rings 60 and at its lower end via ring 62 to a laterally extending lug 64 on the front plate 42. The rear spring 59 is similarly fastened to the rear of hanger plate 54 and the rear wall 43. The center two springs 57, 58 are connected at their top ends, respectively, to the front and rear of hanger plate 54 and at their lower ends to a lug 66 welded on the sidewall 40 midway between the front and rear walls. An identical spring arrangement is provided at the opposite side of frame 38. As will later be more apparent, the spring arrangement insures that the frame can maintain a horizontal position when placed against the top surface of markers having different configurations and also permits the frame to move downwardly against the tension of the springs when the plate 44 is impacted by hammer 10.

The hanger plate 54 at the left side of tower 14 as viewed in FIG. 1 is pivotally connected at 70 to the lower end of a cable 72 which passes upwardly in a straight run over an idler pulley 74 with the cable continuing upwardly and over a pair of pulleys 76, 78 at the top of tower 14, and then downwardly around a further pulley 80 (FIG. 2) and then back upwardly where it is fastened at its other end to the piston 82 of a hydraulic cylinder 84 mounted on the hammer tower 14. Cylinder 84 is controlled by a hand operated valve 86 mounted on a front frame 90 carried on tower 14. Suitable hydraulic interconnections can be provided as illustrated by the hydraulic lines 92 interconnecting the cylinder 84, the control valve 86 and the hydraulic pressure system (not shown) so that a worker can actuate cylinder 84 while he is standing in front of or at the side of tower 14 to raise and lower frame 38. In a similar fashion, the hanger plate 54 at the right of tower 14 as viewed in FIG. 1 is connected at 94 to the lower end of a cable 96 that passes upwardly between an idler pulley 98 and a second groove on the pulley 80 with the upper end of cable 96 being connected to piston 82. With this arrangement, when piston 84 is actuated, cables 72, 96 move in unison to raise and lower frame 38 while the lower surface 50 of the timbers stays in substantially a horizontal plane.

Figure 4:
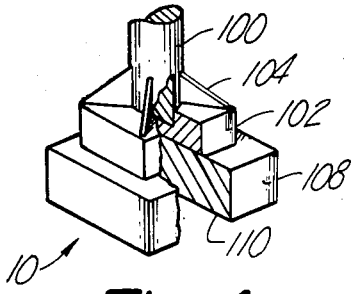
FIG. 4 is a perspective view, partly broken away and in section, of a lower end of a hammer on the percussion unit.
Figure 5:
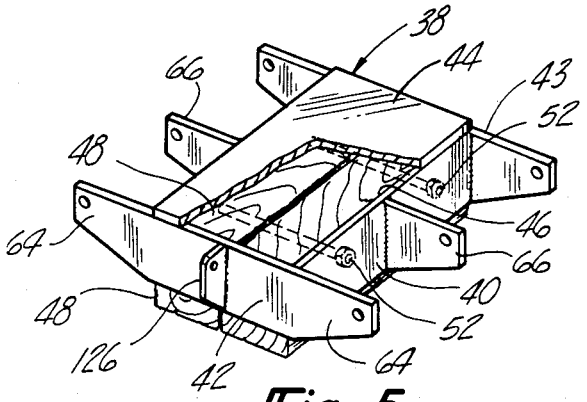
FIG. 5 is a perspective view, partly broken away and in section, of the impact transmitting means.

Referring now to FIGS. 1, 2 and 4, as indicated earlier, the hammer portion of the commercially available percussion units has been modified slightly according to the present invention to better withstand repeated battering against the top plate 44 of the frame 38. The weight 12 is fastened at its lower end to a vertical column 100 that, in turn, has its lower end welded in a 2-inch thick steel block 102 with four reinforcing struts 104 being welded to column 100 and block 102 at positions equally spaced circumferentially about the column to further reinforce the hammer 10. Block 102 is, in turn, welded to a larger 2-inch thick steel block 108. Block 108 has a cross section in a horizontal plane of about 10 inches by 10 inches and has a flat lower face 110 for impacting against the top face 44 on the frame 38. Since the horizontal area of block 108 is substantially smaller than the area of plate 44, frame 38 can be manipulated so that hammer 10 strikes plate 44 at selected locations. On the other hand, plate 44 distributes the concentrated impact of hammer 10 over larger areas for impacting marker 36. In this regard, the area of timber surface 50 is slightly larger than a typical cemetery marker.

Figure 3:
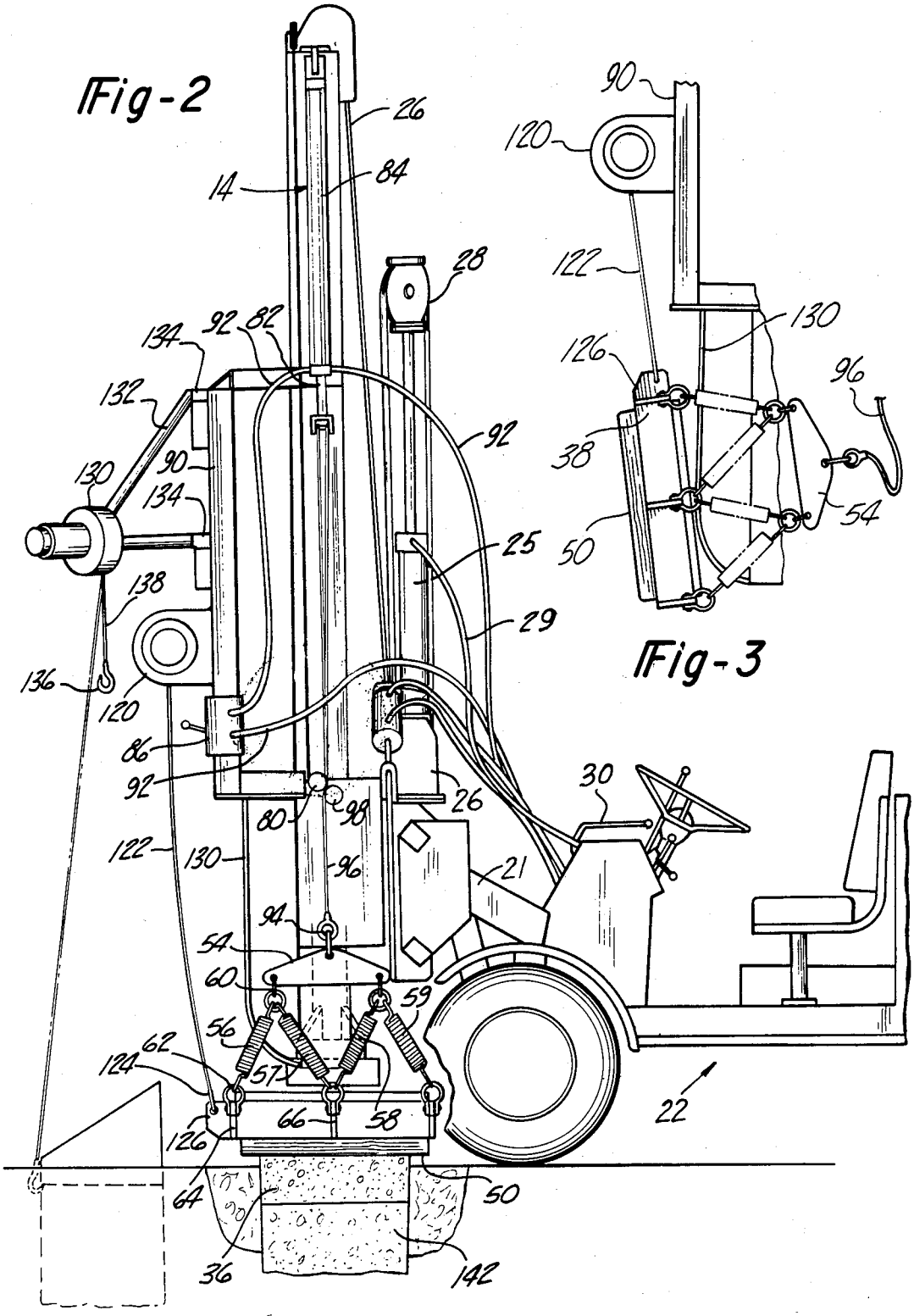
FIG. 3 is a fragmentary side view showing an impact transmitting means of the present invention, swung forwardly and upwardly from its position illustrated in FIG. 2.

Also mounted on frame 90 slightly forward of the tower 14 is an electric motor-driven wench 120 having a cable 122 that is pivotally fastened at 124 on a lug 126 welded on the front plate 42. A pair of curved guide rails 130 are mounted at their lower end on tower 14 and at their upper end on frame 90 so as to project slightly forward of the hammer 10 and guide the frame 38 forwardly when it is raised upwardly by retracting cable 122. As shown in FIG. 3, the frame 38 can be raised completely out of the way of hammer 10 as may be required during travel of tractor 22 or so that hammer 10 can be used for other purposes. With some lightweight markers such as sandstone, limestone or deteriorated markers, or in other situations justifying such procedure in the opinion of the operator, the marker can be removed and the foundation 142 driven down with hammer 10 and then the stone replaced. Additionally, cable 122 can be used to slightly tilt the frame 38 if required for driving a particular type of cemetery marker.

A further electric wench 130 is also mounted on the frame 90 by means of struts 132 which are pivotally connected to the frame 90 as 134. A hook 136 is fastened at the lower end of a cable 138 of wench 130. In working with cemetery markers, it is frequently convenient to have a separate power-driven wench that can be used to assist the workman in dislocating, reorienting or even moving the marker as illustrated generally in broken lines in FIG. 2.

Figure 6:
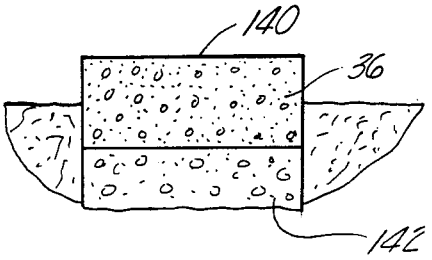
FIGS. 6–10 are views schematically illustrating the manner in which two different types of markers and their foundations can be driven into the ground according to the present invention.
Figure 7:
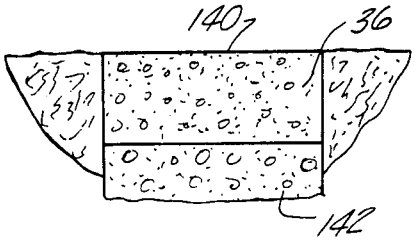

In using the self-propelled unit of the present invention, the tractor 22 is driven to the site of a marker 36 (FIGS. 1, 6 and 7) and positioned so that the hammer 10 is located directly above the center of the top surface 140 of the marker. Usually, the markers will be in a row extending the direction of travel of tractor 22 so that the long dimension of the marker 36 corresponds to the long dimension of frame 38 and tractor 22 straddles the row of markers. As illustrated schematically in FIG. 6, the marker extends or projects upwardly above the ground surface to a height where it would interfere with the passage of a lawn mower over the marker when the mower blade is operating at a normal cutting height. Flat rectangular markers of the type shown in FIG. 6 may be 12 inches by 24 inches, made of granite or marble, and typically project from 4 to 6 inches above the ground but could be as high as say 14 inches. As also illustrated in FIG. 6, marker 36 is typically installed on top of a foundation 142 which would have to be dug up manually if one attempts to relocate the marker 36 manually. The exact nature and arrangement of the foundation 142 varies greatly depending, in part, for example, on location, the practice at the cemetery involved, soil conditions and the year in which it was originally installed. The foundation might be a concrete pad 6 to 8 inches thick or, in some instances, it can be concrete footing that extends a substantial depth of up to 42 inches, for example.

When hammer 10 is positioned over marker 36 and frame 38 centered over the marker, and hence centered with respect to the hammer, the frame is lowered by lowering cables 72, 96 until the bottom surface 50 of timbers 48 engages with the top surface 140 of the marker. In the preferred mode of operation, the cables are adjusted so that the springs 56–59 are in tension and supporting some of the weight of the frame and so that plate 44 is horizontal or parallel with the bottom surface 110 of hammer block 108. This insures that the hammer 10 will strike the top plate 44 over the entire interface therebetween; and if the marker is tipped slightly, the impact will tend to level the top surface of the marker as it is driven downwardly. After the frame is positioned, the operator on tractor 22 actuates handle 32 to move hammer 10 and weight 12 to their raised position, at which point the weight is automatically released. The impact of hammer 10 on plate 44 is transmitted via timbers 48 to marker 36, driving it and foundation 142 downwardly into the ground. After each impact, the operator on the tractor will again actuate the cylinder 84 to raise the weight 12 and hammer 10 and repeatedly impact frame 38 and marker 36 until the foundation and marker are driven downwardly to a level where the top surface 140 is substantially flush with the ground.

A typical marker that might extend 4 to 6 inches above the ground can be pounded flush with the ground with one to five impacts by hammer 10 which will take only a matter of seconds or, at most, several minutes. The unit is preferably manned by an operator on tractor 22 to operate hammer 10 via cylinder 22 and a second workman standing in front or at the side of the precussion unit so that he can make sure that the frame 38 remains properly positioned as the marker is driven flush with the ground. The workman standing at the front of the unit can, via valve 86, progressively lower cables 72, 96 to maintain timbers 48 horizontal and in engagement with the marker and true to the hammer while keeping the springs 56–59 slightly tensioned. As indicated earlier, if a marker is slightly tilted, by keeping the frame 38 horizontal, the impact will be concentrated at the high side of the marker and will, as the marker is driven into the ground, level the top surface of the marker. Where this is not fully accomplished, as the marker is driven downwardly, the operator on the tractor can change the vertical orientation of the tower 14 and the workman at the front of the percussion unit can maneuver the frame 38 so that the impact is transmitted directly to the high side of the marker. This technique is also useful where the terrain is not level and it is desired to have the top surface of the marker conform to the terrain. After one marker is pounded into the ground, tractor 18 is driven to the next marker and it is pounded into the ground in the manner described hereinabove.

Figure 8:
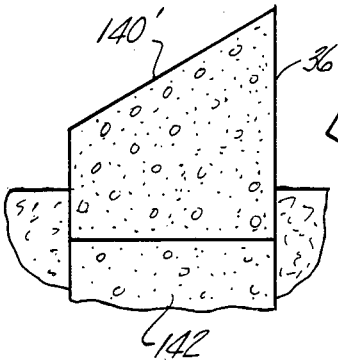
Figure 9:
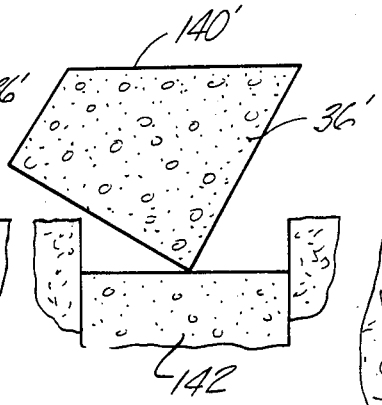
Figure 10:
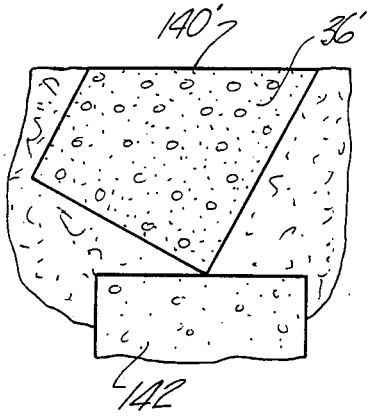

Referring to FIGS. 8, 9 and 10 which illustrate another type of cemetery marker 36' having an inclined top surface 140', the hook 136 and cable 138 can be used to lift or raise the front edge of the marker 36 and tilt is backward to the position illustrated in FIG. 9. The workman can then center the tilted marker 36'and align it with other markers. With the marker tipped as shown in FIG. 9, the workman lowers the frame 38, while keeping it horizontal, and lets it rest on the top surface 140'. In most cases, the weight of the frame and the tension in springs 56–59 are such that marker 36' will stay in the tilted orientation as it is driven downwardly until the top surface 140' is substantially flush with the ground as illustrated in FIG. 10. When a marker is tipped as illustrated in FIGS. 8–10, the marker 36' and foundation 142' may crumble or fracture slightly at the interface therebetween. However, it has been found that this does not usually cause any visible damage to the marker once it is in place. It is usually desirable to back fill under the bottom face of a tipped marker 36' before it is driven to prevent settling.

Although the operation of the percussion unit has been described hereinabove in two examples wherein the springs 56–59 at both sides of the frame 38 are preferably kept tensioned, it will be apparent that the principal purpose of the springs is to permit the workmen to keep the frame 38 horizontal and trued relative to the hammer 10, which, in turn, will tend to drive the high side of the marker downwardly, leveling the marker and insuring that the full force of the hammer 10 strikes the plate 44 directly. This also minimizes stresses on hammer 10 and tends to reduce secondary impacts that might be caused by a wobble at the frame. In order to achieve these objectives, depending on the circumstances, it may be necessary or desirable to permit the springs, at least at one side of the frame, to relax. On the other hand, where the top surface of the marker is substantially level before it is driven, the marker could be driven with the springs slack. However, it is preferred to keep the springs 56–59 at least slightly tensioned since the springs also tend to prevent the frame 38 from becoming misaligned with the marker.

One of the more important aspects of the present invention is the recognition and implementation thereof that a percussion tool can effectively drive cemetery markers flush with the ground in a simple and effective manner without damage to the marker. Before the practicality of the present invention was established by extensive testing, it was not at all certain that markers could be driven by brute force without substantial damage, if not complete fracturing, of the marker. However, based on the experience of driving hundreds of markers, it is estimated that the breakage is perhaps about one percent or less. Breakage is more likely to occur with slant-faced markers such as that shown in FIGS. 8–10, particularly where the marker is high or the angle of the slant face is great. Generally, sandstone and limestone markers should be removed and the foundations driven separately. Breakage can be reduced by exploring the area under the marker and foundation with a long steel rod if the marker does not move with a couple of blows. If the foundation bottoms on a large buried object, such as a large rock or vault, it may then be necessary to reposition the marker manually; but this does not occur very often.

Another important feature of the present invention is that the use of a wooden cushioning pad provided by timbers 48 eliminates scarring of face 140 of the marker 36 which would, of course, be undesirable. Additionally, the cushioning effect of the soft wood distributes the impact force over the entire surface of the marker to minimize fracturing the marker. The construction described hereinabove has proved very effective in driving numerous different configurations of markers without scarrring, fracturing or otherwise damaging the markers.

Although various types of percussion tools capable of driving a hard blow could be used, a percussion tool having a heavy weight on the order of 1000 pounds is preferred and can provide the necessary driving force for a wide variety of conditions. The specific height to which weight 12 is lifted and the number of impacts depends on a number of factors including soil types and soil conditions, principally moisture content. By way of further illustration, when driving a marker and its associated foundation is moist loam soil, weight 12 might be lifted only 1 to 4 inches and just slightly higher for sand, for example, 1 to 6 inches. In heavier soils, weight 12 might be lifted from 1 inch to 2 feet in the case of sandy clay and from 1 inch to 4 feet in the case of clay. Hence, generally speaking, the impact will be the equivalent of dropping a 1000-pound weight a distance in the range of from 4 inches to 2 feet. A lighter weight, for example, a 500-pound weight, raised a higher distance could be used; but the heavier 1000-pound weight is preferred to reduce bouncing and secondary impact between hammer 10 and plate 44 and between timbers 48 and market 36.

The present invention also contemplates mounting frame 38 on tower 14 by means other than a cable-spring suspension systems. For example, frame 38 could be mounted on tower 14 by hydraulic cylinders arranged to constantly urge frame 38 downwardly on the marker. However, the cable-spring arrangement is preferred because it allows the operator flexibility in positioning frame 38 relative to the marker and hammer 10 and it can absorb the shock associated with an impact without unnecessary stress on the suspension system. Although a front-mounted percussion unit has been described, it will be understood that reat-mounted units could also be used.

It is estimated that in areas of low labor costs, a marker can be driven into the ground using the method and apparatus of the present invention at a cost that would be equal to about the cost to trim the marker for a two or three year period. In higher labor cost areas, the markers can be driven flush with the ground with the present invention at approximately the same cost to hand trim the markers over one season. Of course, once the marker is driven flush with the ground, maintenance costs are reduced substantially since the cemetery can be kept neat appearing with self-propelled mowers that can pass over the markers with the cutting blade operating at a normal cutting height of say about 2 to 4 inches.

Figure 14:
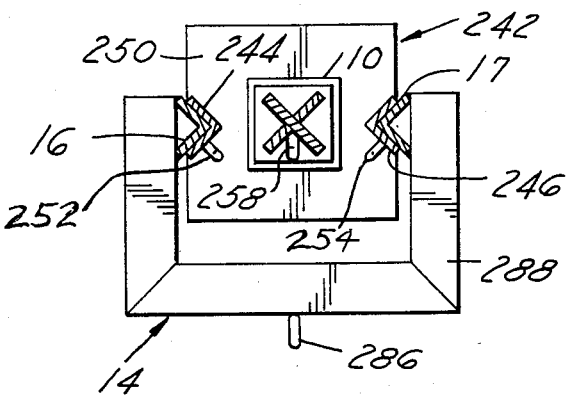
FIG. 14 is a sectional view taken along the line 14—14 in FIG. 13.
Figure 15:
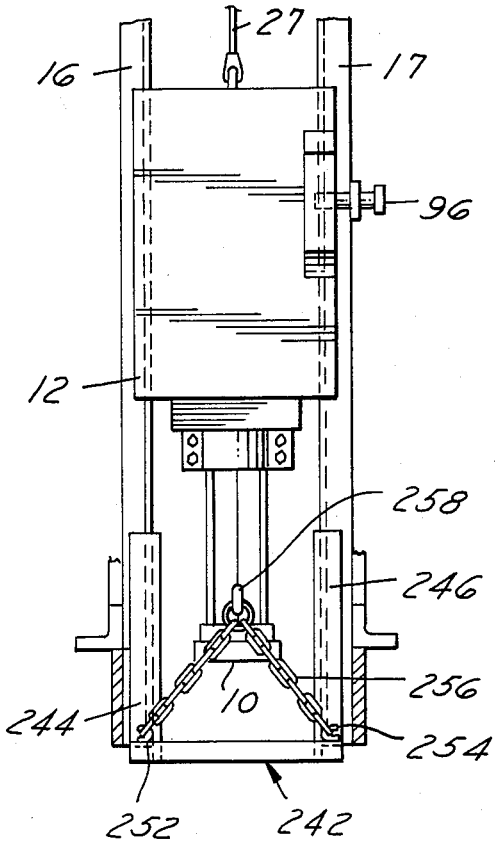
FIG. 15 is a view generally along the line 15—15 in FIG. 11 showing the invention in a modified mode of operation.

In accordance with a second aspect of the present invention, the prior art percussion tool outlined above is modified for selectively generating either P-waves—i.e., generated with a vertical orientation with respect to the earth surface—or shear waves—i.e., at an angle of less than ninety degrees with respect to the earth surface—for subsurface seismic geophysical exploration. More specifically, in accordance with a preferred embodiment of the invention illustrated in FIGS. 11–15 and 19, a shock-transmitting plate 242 weighing on the order of two hundred pounds, for example, is slidably carried on track members 16,17 by a pair of V-shaped guides 244,246 extending upwardly therefrom, and has a flat lower face 248 for engaging the earth surface in shock-transmitting relation therewith and flat upper impact face 250 which is substantially perpendicular to the direction of impact from hammer 10. A pair of eyelets 252,254 are mounted on plate 242 adjacent guides 244,246 to cooperate with a chain 256 (FIG. 15) and an eyelet 258 (FIGS. 13–15) added to hammer 10 to support plate 242 as shown in FIG. 15 during non-use or translocation of the seismic generator, as will be explained in detail hereinafter. As will be best appreciated with reference to FIG. 14, the shock-transmitting surface area of plate 242 is substantially greater than that of hammer 10, so that the impact forces of hammer 10 as the latter is dropped onto the plate are spread over an enlarged area of the earth surface.

Figure 11:
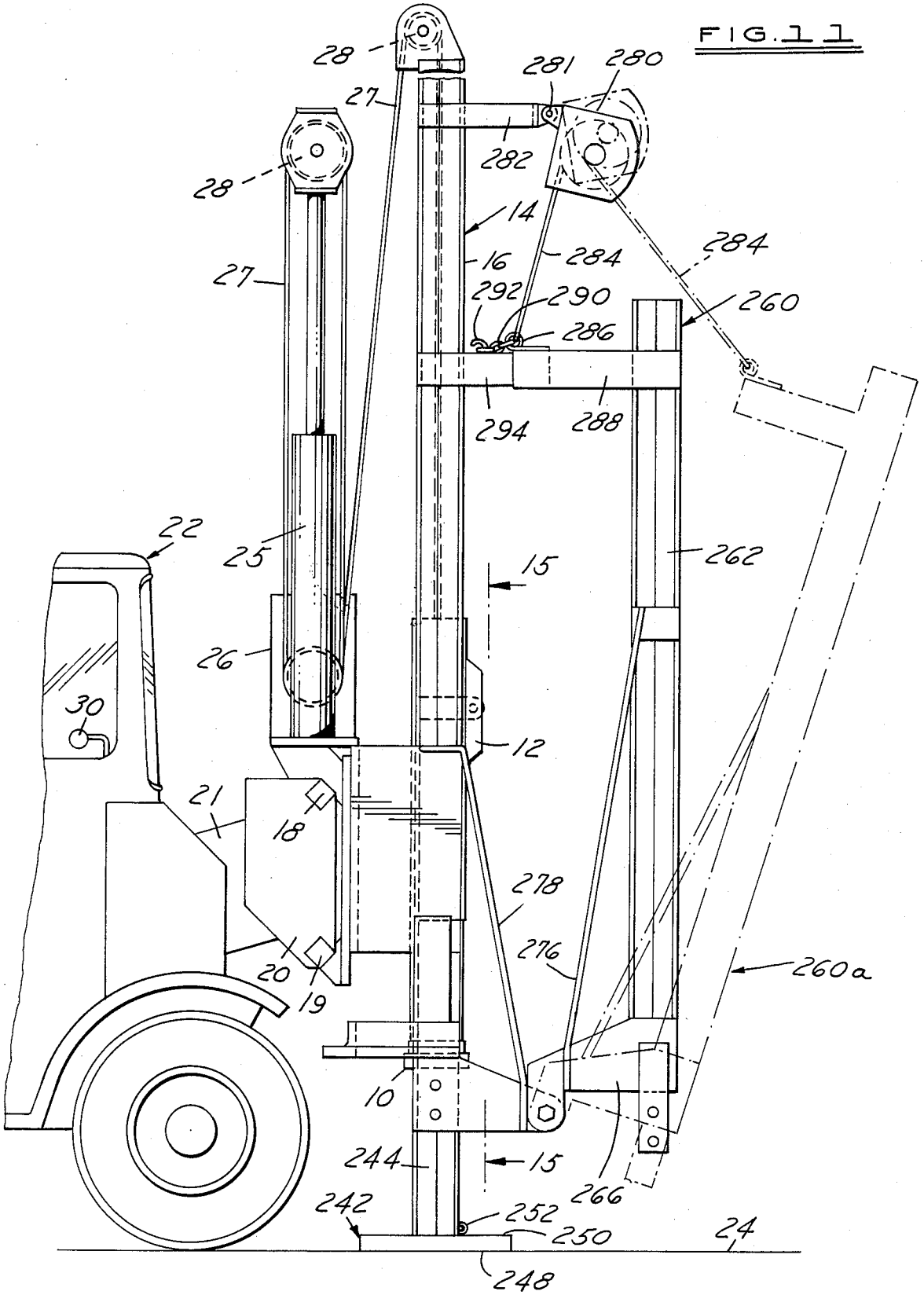
FIG. 11 is an elevational view of a presently preferred embodiment of the invention in one mode of operation for generating seismic P-waves.
Figure 12:
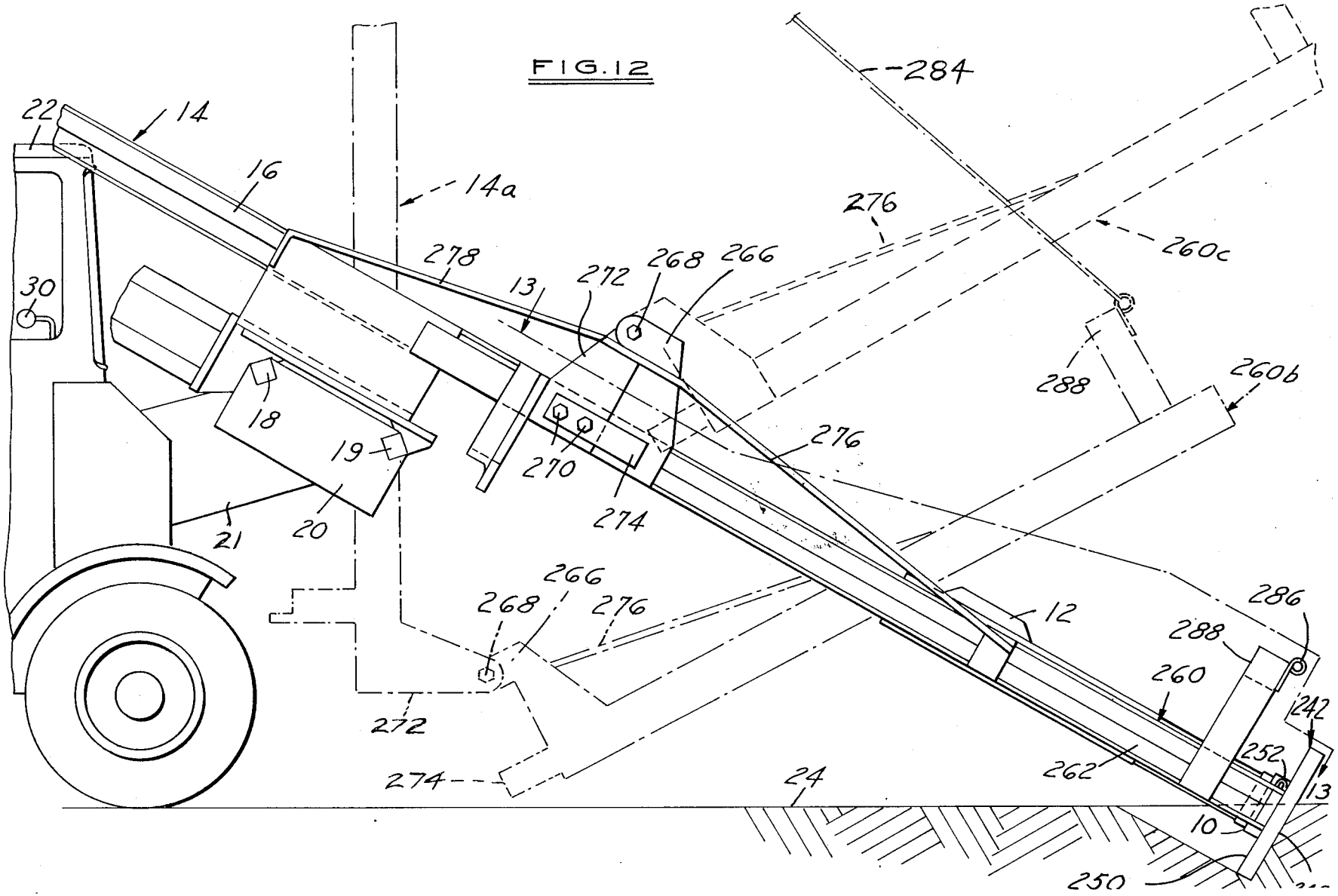
FIG. 12 is an elevational view of the embodiment of FIG. 11 in a second mode of operation for generating seismic shear waves.
Figure 13:
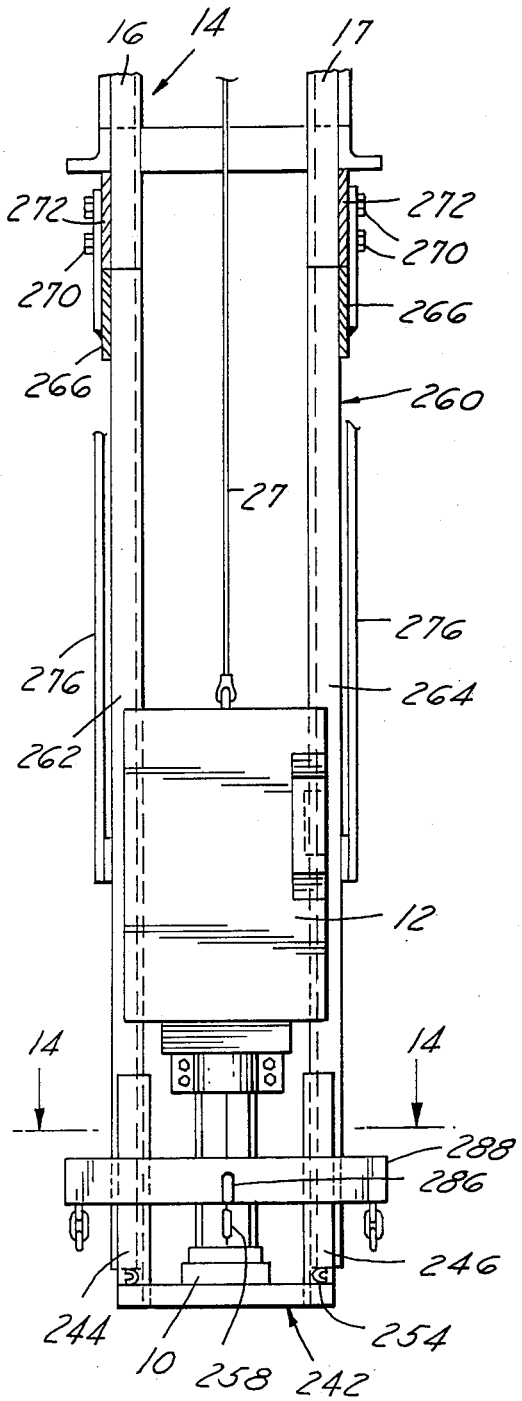
FIG. 13 is a sectional view taken along the lines 13—13 in FIG. 12.
Figures 19, 20:
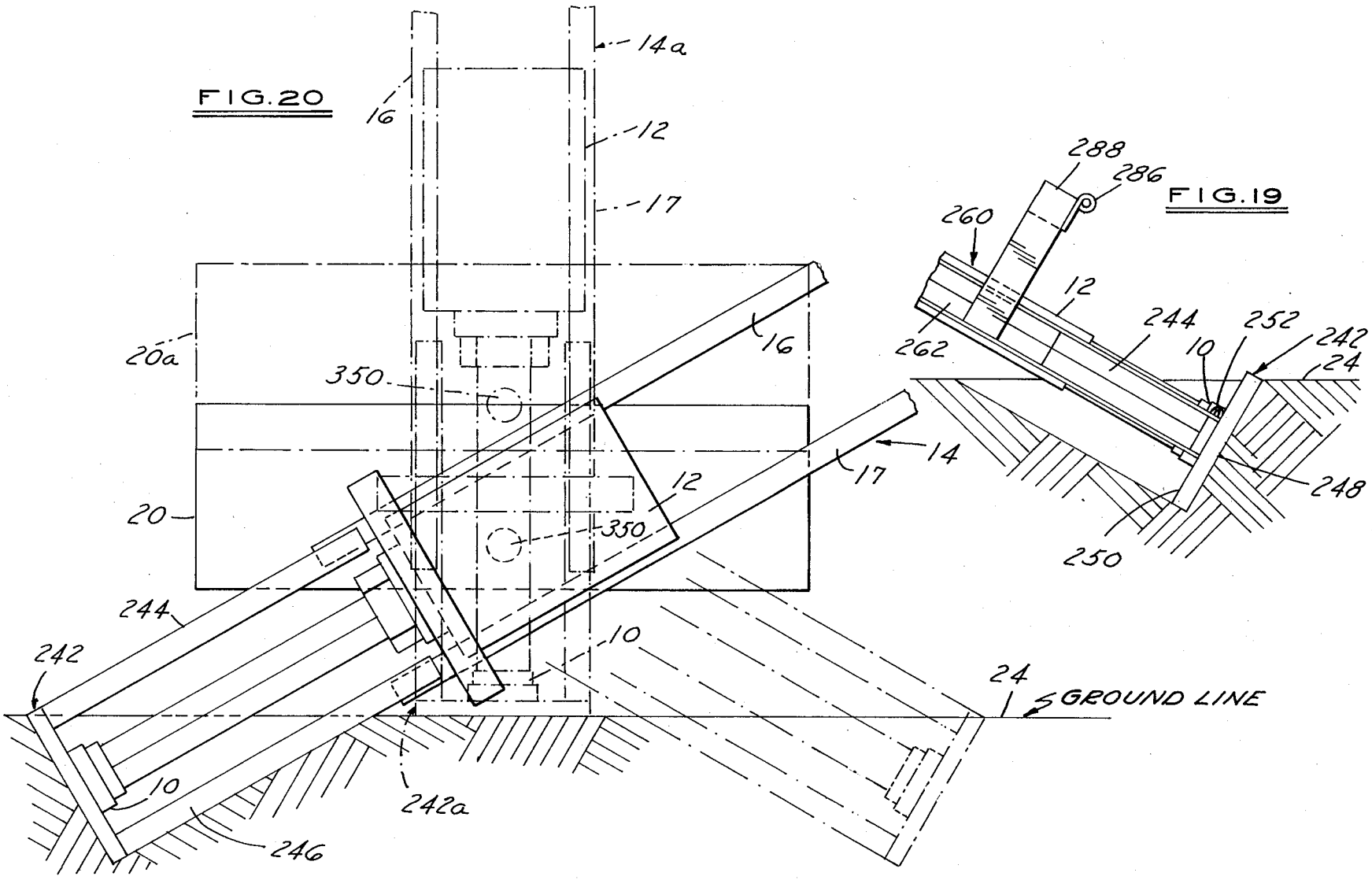
FIG. 19 is fragmentary elevational view illustrating operation of the invention in the mode shown in FIG. 12.
FIG. 20 is a front elevational view of another embodiment of the invention.

A boom 260 comprising a second pair of track members 262,264 with the resepctive end brackets 266 is pivotally carried by the aligned pins 268 (FIGS. 11–12) mounted on brackets 272 at the lower end of each track member 16, 17 track members 262,264 being thereby pivotable between a first position illustrated in solid lines in FIG. 11 wherein track member 262,264 are in a stored or unused position relative to track members 16,17 and a second position illustrated in solid lines in FIGS. 12–13 and 19 wherein track members 262,264 are respectively aligned with track members 16,17 such that weight 12 and plate 242 may slide therealong. A leg 274 extends longitudinally from each end bracket 266 and is fastend to the corresponding bracket 272 by the bolts 270 to retain the track members in the aligned second operating position illustrated in FIGS. 12–13. Supporting braces 276,278 extend between brackets 266,272 and the corresponding track members 262,264 and 16,17 externally of the track members so as not to interfere with sliding motion of plate 242 and weight 12 therealong. An electrical winch 280 is pivotally mounted by a pin 281 on a yoke 282 attached to the upper end of tower 14 and has a retractable cable 284 extensible therefrom for selective attachment to an eyelet 286 on a yoke 288 at the remote end of boom 260 to move boom 260 between the above-mentioned first position illustrated in FIG. 11, wherein boom 260 is held to tower 14 by a link 290 extending between eyelet 286 and an eyelet 292 on a tower yoke 294, and the second position illustration in FIGS. 12–13 and 19.

Operation of the seismic wave generator provided by the invention will now be described. The self-propelled generator is translocated to a test site with boom 260 held in the non-use position illustrated in FIG. 11 and with plate 242 carried by hammer 10 as illustrated in FIG. 15. A safety locking pin 296 (FIG. 15) extends as shown in the aforementioned U.S. Pat. No. 3,172,483 though aligned apertures in track member 17 and weight 12 to hold the weight and hammer in fixed position during translocation. When the generator reaches a test site, and when it is desired to generate seismic P-waves, tower 14 is pivotally adjusted to a substantially vertical orientation and laterally adjusted over a relatively flat area of the earth surface, and then weight 12 and plate 242 are lowered until the lower face 248 of plate 242 rests upon the earth surface as illustrated in FIG. 11. Guides 244,246 are of sufficient length as not to become laterally disengaged from and misaligned with track members 16,17 in the lowered position. However, the geometry of guide 244,246 and track members 16,17 relative to the direction of impact of hammer 10 is such that plate 242 is effectively vibrationally uncoupled from tower 14 and vehicle 22. Weight 12 may then be repeatedly raised to a distance less then the full tower height, an on the order of one or two feet, and then released to "tamp" plate 242 into the earth surface and thereby to assure good seismic coupling therebetween. Weight 12 and hammer 10 may then be raised to a greater height, such as the full tower height of eight feet, and then released to fall by gravity through a vertical path against the upper impact face 250 of plate 242 thereby to generate seismic P-waves beneath the earth surface.

To generate shear seismic waves, weight 12, hammer 10 and plate 242 are first located and locked in the position illustrated in FIG. 15. Link 290 is then removed from eye 292, and boom 260 is swung by gravity against the restraining force of operator-controlled winch 280 through the successive positions illustrated at **260*a* in FIG. 11, 260*b* and 260*c* in FIG. 12, and finally to the position illustrated in solid lines in FIGS. 12 and 19 wherein bolts 270 are attached. Note that between boom position 260*b* and 260*c* to FIG. 12, tower 214 is pivoted by fame 20 between the upright position illustrated in phantom at 14*a* in FIG. 12 and the position illustrated in solid lines in the same figure. Weight 12 and plate 242 are then slowly lowered until the lower edge of plate 242 engages the earth surface. Vehicle 22 may be moved forwardly to force plate 242 into the earth surface to the position illustrated in FIG. 12 wherein boom 260 terminates at about the level of the earth surface. Chain 256 (FIG. 15) is then slackened and removed, and weight 12 and hammer 10 are repeatedly raised and released as described above to tamp plate 242 into the ground. Preferably, plate 242 is tamped into the ground until the entire plate penetrates the earth surface—i.e., until the top plate edge is flush with the earth surface as shown in FIG. 19 and plate impact face 250 is exposed to hammer 10 from above the earth surface. This preferred position of plate 242 for shear wave generation promotes maximum seismic coupling. The weight and hammer may then be raised to the end of tower 14, for example, and released to fall against plate 242** by gravity to generate seismic shear waves.

Guides 244, 246 are sufficiently long to prevent misalignment of plate 242 with tower 14 and boom 260, as best seen in FIG. 19 but are substantially vibrationally isolated from track members 262,264. To move the generator to a new site, plate 242 may be retracted from the earth surface either by hammer 10 with chain 256 (FIG. 15) or by winch 280 (FIG. 11) and cable 284. If the new site is nearby, the aligned track members may be pivoted away from the earth surface by frame 20 and the generator may be translocated to the new site. If the new site is some distance away, the above-described operation may be reversed and the generator may be returned to the operating mode illustrated in FIGS. 11 and 15 combined, and then translocated to the new site.

The seimic wave generator hereinabove described has been tested extensively, particularly in the second or shear mode of operation illustrated in and described in connection with FIGS. 12–13 and 19, and has been found and acknowledged by experts in the field of subsurface geophysical exploration to possess significant advantages over the prior art, particularly the previously-accepted mortar-type generator described above. More specifically, it has been found that the present invention permits accurate repetition of the various test paramenters, particularly impact strength and initial seismic wave amplitude, either immediately after a one test run or after a delay of several days or even weeks. In the seismic exploration test system illustrated in FIG. 18, for example, a seismic pickup or transducer 290 is located on the earth surface at a desired distance from the generator and at right angles to the path of travel of hammer 10. A second transducer 292, such as a piezoelectric pickup, is coupled to plate 242 and connected to a radio transmitter 294 to provide a signal indicative of the time of hammer impact. A suitable chart recorder 296 or the like is connected to transducer 290 and to a radio receiver 298 to provide signal tracings for relating the seismic subsurface echos to the impact time. For additional discussion of seismic shear wave exploration systems, reference is made to U.S. Pat. Nos. 2,740,488 and 2,740,489.

Figures 16, 17, 18:
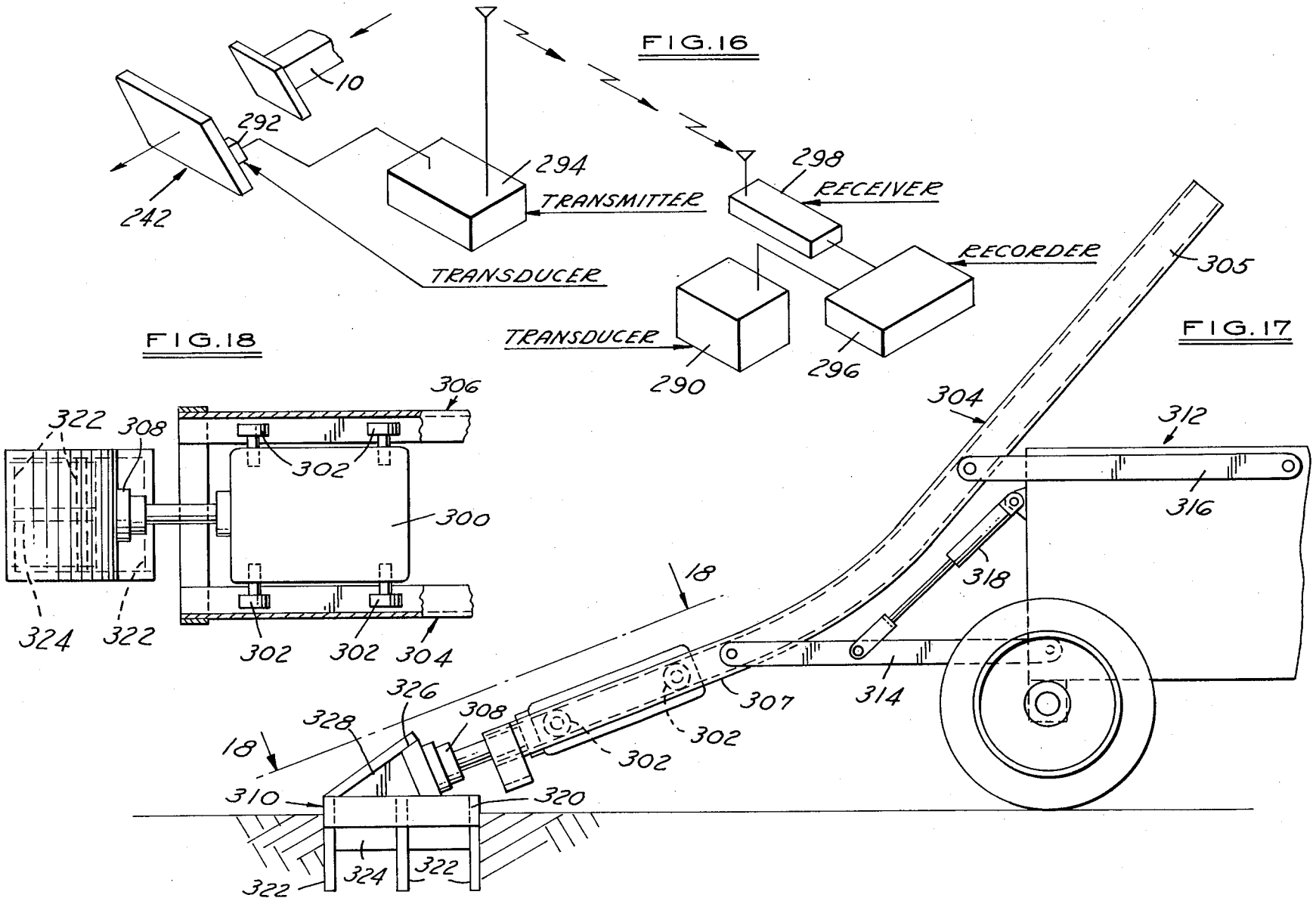
FIG. 16 is an elevational view of an alternative embodiment of the invention for generating seismic shear waves.
FIG. 17 is a sectional view taken along the line 17—17 in FIG. 16.
FIG. 18 is a schematic drawing of a system for conducting subsurface geophysical exploration utilizing seismic shear waves in accordance with the invention.

Moreover, it will be apparent that the generator in accordance with the invention is readily adjustable over a wide variety of shear angles, an angle of about thirty degrees with respect to the earth surface being presently preferred. The present invention is not as loud in operation as is the prior-art mortar seismic generator, and produces no exploding debris which could injure persons in the surrounding area. An alternative embodiment of the invention for generating seismic shear wave is illustrated in FIGS. 16–17 and comprises a weight 300 carried by rollers 302 within channelled tracks 304, 306 and having a hammer 308 extending therefrom. Tracks 304, 306 include an upper portion 305 in FIG. 16 at an angle greater than the ultimate impact shear angle of hammer 308 through which the hammer and weight fall to gather momentum, and a lower arcuate portion 307 in which the angle of travel of hammer 308 is directed at a selected shear angle against a shock-transmitting assembly generally indicated at 310. Tracks 304, 306 are each mounted to a wheeled vehicle 312 by a pair of pivotal links 314, 316, links 314 being coupled to vehicle 312 by a hydraulic ram 318 for adjusting the impact shear angle of hammer 308. Shock-transmitting assembly 310 includes a block 320 having plates 322 depending therefrom laterally of the direction of impact and which are driven into the ground, and longitudinal support struts 324 connected between plates 322. An impact faceplate 326 is carried by block 320 with a filler section 328 being disposed on block 320 therebehind. Preferably plate 326 is pivotally adjustable on block 320 to accommodate a variety of impact shear angles.

Another embodiment of the seismic wave generator provided by the invention is illustrated in FIG. 20 wherein the basic selfpropelled percussion unit illustrated in above-referenced U.S. Pat. No. 3,172,483 is modified in two additional respects. Firstly, the track-support frame 20 is carried to be reciprocable vertically at least between positions illustrated at 20 and **20*a* (phantom) in FIG. 20, and a hydraulic ram (not shown) or the like is provided to control such reciprocation. Secondly, the pivotal coupling 350 (FIG. 20) between frame 20 and track 14 is modified such that track 14** may be pivoted through an arc of at least sixty degrees on either side of vertical, and suitable means are provided to control such track motion.

In a first mode of operation of the embodiment of FIG. 20, frame **20*a* is positioned as indicated, the track is positioned vertically as shown in phantom at 14*a* and the shock transmitting plate is positioned on the earth surface beneath the track as shown in phantom at 242*a*. Hammer 10 and weight 12 may then be dropped onto plate 242*a* to generate seismic P-waves as hereinabove described. The plate, track and frame may then be lifted slightly, and the track may be pivoted about coupling 350 in the lateral direction, i.e., in the plane of track members 16,17. The frame is lowered to the position illustrated at 20 in FIG. 20 as the track is pivoted to the position illustrated at 14 until the lower track end is adjacent the earth surface at a preselected shear angle with respect thereto, thirty degrees in the drawing. Plate 242 may then be tamped into the earth surface and shear seismic waves may be generated as hereinabove described. If required, a support leg (not shown) or the like may be positioned between the track and the earth surface at the plate-remote end thereof to insure that the percussion unit does not topple when hammer 10 and weight 12** are lifted.

The plate, track and frame may then be lifted, the track pivoted and frame lowered as hereinabove described to a second shear orientation illustrated in phantom by means of plate **242*b* in FIG. 20 wherein shear seismic waves are generated in a direction substantially complementary to those generated at the track orientation illustrated in solid lines in FIG. 20. It has heretofore been recognized that complementary shear wave generation, particularly at closely spaced intervals, has beneficial effects in seismic exploration. In accordance with the embodiment of the invention illustrated in FIG. 20**, such complementary shear waves, and also P-waves, may be generated in a matter of seconds using a single apparatus. Moreover, because the hammer drop height and the track angle may be closely controlled, the amplitude and angles of successive waves may be repeated with enhanced accuracy.

From the foregoing description it will be appreciated that the seismic wave generation method and apparatus provided by the invention fully satisfies all of the objects and aims previously set forth. In accordance with one important feature of the invention, seismic shear waves may be generated for subsurface geophysical exploration by both tamping a shock-transmitting means (e.g., plate 242 in FIGS. 11–15 and 19–20) into the earth surface and then generating exploration waves by directing an impact hammer against the shock-transmitting means by lifting the hammer to preselected heights above the earth surface, releasing the hammer and then guiding the hammer through a preselected path (e.g., by tracks 16–17, 262–264 in FIGS. 11–15 and 19–20) as the latter falls by gravity against the shock-transmitting means. In accordance with a further facet of this aspect of the invention, subsurface geophysical exploration may be carried out by recording subsurface echo signals (FIG. 16) at a distance from the generator and simultaneously recording indicia originating at the generator indicative of the moment of impact.

In accordance with another important feature of the invention, apparatus (FIGS. 11–15 and 19–20) is provided for selectively generating either P-waves or shear waves for geophysical exploration. Such apparatus includes impact hammer means (10–12), an elongated track (16–17, either alone or in combination with 262–264) for guiding the impact hammer, a shock-transmitting plate (242), means operable in one (P-wave) mode of operation for orienting the track vertically with the shock-transmitting plate being disposed on the earth surface therebelow, and means operable in a second (shear wave) mode of operation for orienting the track at a shear angle with respect to the earth surface and with at least a portion of the shock-transmitting plate penetrating the earth surface.

Although the invention in all of its aspects has been described with respect to specific embodiments thereof, many alternatives and modifications will suggest themselves to the skilled artisan. For example, it is presently preferred to exercise manual control over the lifting and releasing of the hammer and weight to provide for an extended indeterminate period between impacts to allow subsurface echos to dissipate. However, it may be desirable in some circumstances to provide for automatic repetition of seismic wave generation after a preselected time period, a modification which may be readily incorporated into the hydraulic system of the present invention but not into the completely manual mortar system of the prior art. Similarly, although the invention has been described as being carried by a wheel vehicle, other types of vehicles are contemplated, specifically self-propelled tracked vehicles which may be particularly useful for translocating the seismic wave generator over rough terrain.

Although the seismic wave generator has been described as comprising articulated track members, it is within the scope of the invention to provide such members as an elongated integral unit which may be oriented vertically and only the lower portion utilized for generating seismic P-waves. Indeed, the embodiment of the invention discussed in connection with FIGS. 1–10 for driving cemetary markers, including impact-transmitting member 34, has been utilized to advantage for generating seismic P-waves. In this mode of operation, member 34 is placed on the earth surface and hammer 10 is dropped thereon. Similarly, the embodiment of FIGS. 1–10 may be and has been utilized for generating seismic shear waves. However, in the latter mode of operation, particularly as the shear impact angle approaches the preferred angle of thirty degrees, it is preferable to provided elongated track members so that the impact weight and hammer may fall through a sufficient vertical distance to gather substantial momentum.

Although plate 242 (FIGS. 11–16 and 19–20) having a flat earth-engaging bottom surface 248 is presently preferred for generating both seismic P-waves and shear waves, other configurations, such as a concave or studded lower surface, are envisioned. It will also be understood that the shock-transmitting plate 242 may be carried by rollers within the guide channels 305,306 in the shear wave generator 312 of FIGS. 17–18. Accordingly, the invention is intended to embrace the above-noted and all other alternatives, modifications and variations as fall within the spirit and broad scope of the appended claims.

The invention claimed is:

1. A method of generating seismic shear waves for subsurface geophysical exploration comprising the steps of locating a plate-like shock transmitting means on the earth surface such that a portion of said shock transmitting means having an impact face being exposed from above the earth surface, and said shock transmitting means having a second portion directed towards the earth and positioned on the earth surface at a preselected shear angle substantially less than 90° and greater than zero° with respect to horizontal, directing an impact hammer against said impact face of said shock-transmitting means with an impact force in a direction substantially equal to said preselected shear angle with respect to horizontal of said second portion of said shock transmitting means, said impact force substantially at right angles to said impact face of said shock-transmitting means and transmitting a shear wave and compression wave in the earth in response to said impact hammer contacting said shock transmitting means.

2. A seismic wave generator for subsurface geophysical exploration comprising elongated guideway means, impact hammer means carried by said guideway means for longitudinal motion with respect thereto, shock-transmitting means adapted to be disposed beneath one end of said guideway means, means operable in one mode of operation for orienting said guideway means substantially vertically with respect to the earth surface with said shock-transmitting means being disposed on the earth surface beneath said guideway means, means operable in a second mode of operation for orienting said guideway means at a preselected shear angle substantially less then 90° and greater than zero° with respect to horizontal with a first portion of said shock-transmitting means disposed at least in part below the earth surface and a second portion of said shock-transmitting means being exposed to said impact hammer means at an angle substantially equal to the preselected shear angle and means for directing said impact hammer means along said guideway means against said shock-transmitting means for transmitting a P-wave and shear wave into the earth in response to the hammer means contacting said shock transmitting means.

3. A method of generating seismic shear waves for subsurface geophysical exploration comprising the steps of locating a plate-like shock transmitting means on the earth surface such that a portion of said shock transmitting means having an impact face being exposed from above the earth surface, and said shock transmitting means having a second portion directed towards the earth and positioned on the earth surface at a preselected shear angle substantially equal to 30° with respect to horizontal, directing an impact hammer against said impact face of said shock-transmitting means with an impact force in a direction substantially equal to said preselected shear angle with respect to horizontal of said second portion of said shock transmitting means, releasing said impact hammer and enabling said hammer to fall into engagement with said shock transmitting means by force of gravity, said impact force substantially at right angles to said impact face of said shock-transmitting means and transmitting a shear wave and compression wave in the earth in response to said impact hammer contacting said shock transmitting means.

4. A seismic wave generator for subsurface geophysical exploration comprising elongated guideway means, impact hammer means carried by said guideway means for longitudinal motion with respect thereto, shock-transmitting means adapted to be disposed beneath one end of said guideway means, means operable in one mode of operation for orienting said guideway means substantially vertically with respect to the earth surface with said shock-transmitting means being disposed on the earth surface beneath said guideway means, means operable in a second mode of operation for orienting said guideway means at a preselected shear angle substantially equal to 30° with respect to horizonal with a first portion of said shock-transmitting means disposed at least in part below the earth surface and a second portion of said shock-transmitting means being exposed to said impact hammer means at an angle substantially equal to the preselected shear angle and means for directing said impact hammer means along said guideway means against said shock-transmitting means for transmitting a P-wave and shear wave into the earth in response to the hammer means contacting said shock transmitting means.

* * * * *

UNITED STATES PATENT AND TRADEMARK OFFICE

CERTIFICATE OF CORRECTION

PATENT NO. : 4,715,471

DATED : December 29, 1987

INVENTOR(S) : David W. Fulkerson et al.

It is certified that error appears in the above-identified patent and that said Letters Patent is hereby corrected as shown below:

ON THE ABSTRACT under line 31, "is" should be --it--;

Col. 1, Line 8, after the filing date, status of CIP application (abandoned) is missing;

Col. 1, line 60, "invloves" should be —involves--;

Col. 2, line 30, "econimical" should be --economical--;

Col. 2, line 39, "goephysical" should be —geophysical--;

Col. 2, line 48, "persucsion" should be --percussion--;

Col. 3, line 37, "be" should be —by--;

Col. 3, line 50, "exeception" should be --exception--;

Col. 3, line 51, "contruction" should be --construction--;

Col. 4, line 14, after "will" insert --be--;

Col. 5, line 55, "wench" should be —winch--;

Col. 6, line 6, "wench" should be —winch--;

Col. 6, line 9, "wench" should be —winch--;

UNITED STATES PATENT AND TRADEMARK OFFICE

CERTIFICATE OF CORRECTION

PATENT NO. : 4,715,471

DATED : December 29, 1987

INVENTOR(S) : David W. Fulkerson et al.

It is certified that error appears in the above-identified patent and that said Letters Patent is hereby corrected as shown below:

Col. 6, line 11, "wench" should be --winch--;

Col. 6, line 41, after "be" insert --a--;

Col. 7, line 33, "is" should be --it--;

Col. 8, line 36, "scarrring" should be --scarring--;

Col. 9, line 3, "reat-mounted" should be --rear-mounted--;

Col. 9, line 60, "fastend" should be --fastened--;

Col. 10, line 1, "extensible" should be --extendible--;

Col. 10, line 7, after "294" delete ", and" and insert --in--;

Col. 10, lines 7, 8, "illustration" should be --illustrated--;

Col. 10, line 16, "though" should be --through--;

Col. 10, line 28, "guide" should be --guides--;

Col. 10, line 32, "then" should be --than--;

Col. 10, line 33, "an" should be --as--;

Col. 10, line 51, ""to" should be --in--;

UNITED STATES PATENT AND TRADEMARK OFFICE

CERTIFICATE OF CORRECTION

PATENT NO. : 4,715,471

DATED : December 29, 1987

INVENTOR(S) : David W. Fulkerson et al.

It is certified that error appears in the above-identified patent and that said Letters Patent is hereby corrected as shown below:

Col. 10, line 52, "fame" should be —frame—;

Col. 11, line 19, ""seimic" should be —seismic—;

Col. 11, line 29, "paramenters" should be —parameters—;

Col. 11, line 33, "18" should be —16—;

Col. 11, line 51, "prior-art" should be —prior art—;

Col. 11, line 55, "16-17" should be —17-18—;

Col. 11, line 58, "16" should be —17—;

Col. 12, line 11, "selfpropelled" should be —self-propelled—;

Col. 13, line 65, "provided" should be —provide—;

Col. 14, line 45, "then" should be —than—

Signed and Sealed this

Sixteenth Day of January, 1990

*Attest:*

JEFFREY M. SAMUELS

*Attesting Officer*

*Acting Commissioner of Patents and Trademarks*